US005128623A

United States Patent [19]

Gilmore

[11] Patent Number: 5,128,623

[45] Date of Patent: Jul. 7, 1992

[54] DIRECT DIGITAL SYNTHESIZER/DIRECT ANALOG SYNTHESIZER HYBRID FREQUENCY SYNTHESIZER

[75] Inventor: Robert P. Gilmore, San Diego, Calif.

[73] Assignee: Qualcomm Incorporated, San Diego, Calif.

[21] Appl. No.: 580,177

[22] Filed: Sep. 10, 1990

[51] Int. Cl.[5] ..... G06G 7/02; G06G 7/16

[52] U.S. Cl. ..... 328/14; 328/15; 307/271; 307/529; 364/608; 364/825; 364/851

[58] Field of Search ..... 328/14–15; 307/529, 271; 364/607–608, 825, 851

[56] References Cited

U.S. PATENT DOCUMENTS 4,926,130 5/1990 Weaver ..... 307/529

5,014,231 5/1991 Reinhardt et al. ..... 328/14

*Primary Examiner*—Stanley D. Miller

*Assistant Examiner*—Margaret R. Wambach

*Attorney, Agent, or Firm*—Russell B. Miller

[57] ABSTRACT

A digital/analog hybrid frequency synthesizer having a digital frequency synthesizer for digitally generating an analog output signal of a predetermined frequency within a frequency range of f to f+Δf; an input stage analog frequency synthesizer for, receiving the digital frequency synthesizer output signal and I analog input stage input signals, each input stage input signal separated in frequency from a next one by a frequency increment of Δf wherein a first one and a last one of the input stage input signals are respectively of a frequency of $f_A$ and $f_A+(I-1)\Delta f$, selecting one input stage input signal from the input stage input signals, mixing the selected input stage input signal with the digital frequency synthesizer output signal and providing a resultant input stage output signal; and an output stage analog frequency synthesizer for, receiving the input stage output signal and K analog output stage input signals, each output stage input signal separated in frequency from a next one by a frequency increment of IΔf wherein a first one and a last one of the output stage input signals are respectively of a frequency of $f_N$ and $f_N+(K-1)I\Delta f$, selecting one output stage input signal from the output stage input signals, mixing the selected output stage input signal with the input stage output signal and providing a resultant output stage output signal. Additional intermediate frequency stages may be employed to facilitate greater bandwidth expansion.

32 Claims, 4 Drawing Sheets

PHASE DATA
DDS
DAC
LPF
f+Δf
f
INPUT STAGE
SWITCH CONTROL A
BPF
CLOCK
FREQUENCY GENERATOR
TO INTEMEDIATE AND OUTPUT STAGES
INTERMEDIATE STAGE
SWITCH CONTROL B
OUTPUT STAGE
SWITCH CONTROL N
FROM FREQUENCY GENERATOR
FROM FREQUENCY GENERATOR

DIRECT DIGITAL SYNTHESIZER/DIRECT ANALOG SYNTHESIZER HYBRID FREQUENCY SYNTHESIZER

BACKGROUND OF THE INVENTION

I. Field of the Invention

The present invention relates to frequency synthesis. More particularly, the present invention relates to a novel and improved method and apparatus for generating frequencies within a wide bandwidth with fine resolution.

II. Description of the Related Art

Frequency synthesis has found widespread application in the communications field. Analog frequency synthesizers provide an inexpensive alternative for the generation of a large number of frequencies. However, in certain applications the frequency resolution of analog frequency synthesizers are lacking. In these applications a direct digital synthesizer (DDS) has provided the necessary frequency resolution.

Although with a DDS the frequency resolution is much finer than that of an analog frequency synthesizer, the output bandwidth of the DDS is somewhat limited. In applications where high frequency resolution is required over a large continuous bandwidth a DDS is incapable of meeting this requirement.

It is therefore an object of the present invention to provide a frequency synthesizer that is capable of providing fine frequency resolution over a large bandwidth.

SUMMARY OF THE INVENTION

The present invention is a novel and improved frequency synthesizer which uses both analog and digital frequency techniques in synthesizing signal frequency. The present invention takes advantage of the frequency resolution of a direct digital frequency synthesizer (DDS) within the output signal frequency band of the DDS in addition to the frequency translation capabilities of a direct analog frequency synthesizer. The present invention provides both bandwidth expansion and frequency translation, typically frequency upconversion, while maintaining contiguous frequency coverage at the resolution of the DDS over the expanded bandwidth.

Bandwidth expansion at the resolution of the DDS is provided without frequency multiplication in generating the input signal which can adversely affect the quality of the output signal. In using a DDS to generate the input signal, problems experienced in frequency multiplication, such as noise spurs, phase noise, microphonic behavior and frequency resolution differences are eliminated.

In the exemplary embodiment of the present invention as disclosed herein both digital and analog frequency synthesizer techniques are used. In the present invention a digital/analog hybrid frequency synthesizer is disclosed in which a DDS is utilized for digitally generating a high resolution analog output signal of a predetermined frequency within a frequency range of f to $f+\Delta f$. The DDS output signal is provided as an input to an input stage analog frequency synthesizer.

The input stage frequency synthesizer receives, in addition to the DDS output signal, I analog input stage input signals. Each of the I input stage input signals are separated in frequency from a next one by a frequency increment of $\Delta f$, wherein a first one and a last one of the input stage input signals are respectively of a frequency of $f_A$ and $f_A+(I-1)\Delta f$. The input stage frequency synthesizer facilitates selection of one input stage input signal from the input stage input signals and mixing of the selected input stage input signal with the DDS output signal so as to provide a resultant input stage output signal. The input stage output signal is provided to an output stage analog frequency synthesizer.

The output stage analog frequency synthesizer receives, in addition to the input stage output signal, K analog output stage input signals. Each of the K output stage input signals are separated in frequency from a next one by a frequency increment of $I\Delta f$, wherein a first one and a last one of the output stage input signals are respectively of a frequency of $f_N$ and $f_N+(K-1)I\Delta f$. The output stage frequency synthesizer facilitates selection of one output stage input signal from the output stage input signals and mixing of the selected output stage input signal with the input stage output signal so as to provide a resultant output stage output signal.

Additional intermediate frequency stages may be employed to facilitate greater bandwidth expansion.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 1:
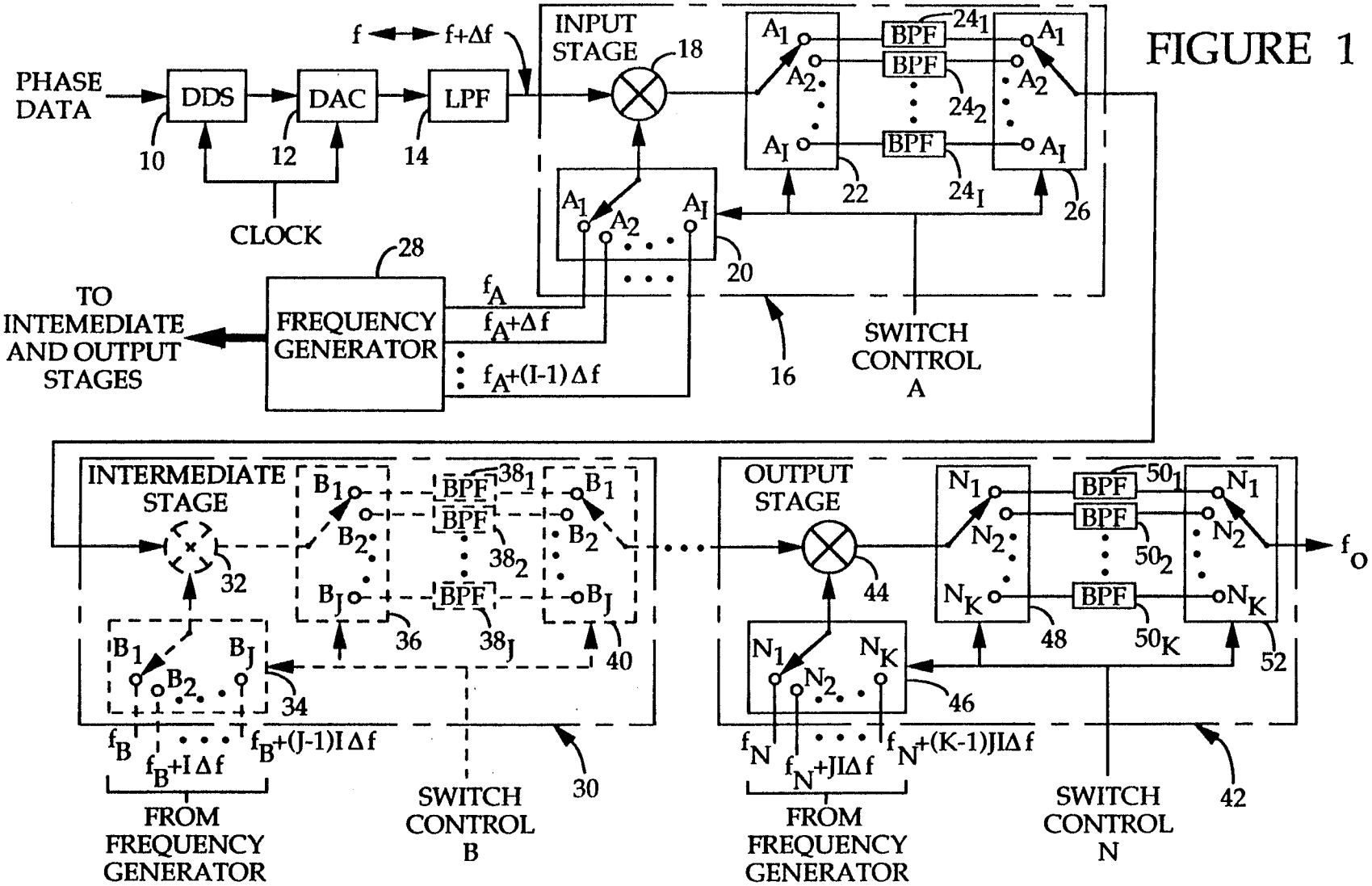
FIG. 1 is a schematical block diagram illustrating an exemplary general configuration of a direct digital synthesizer/direct analog synthesizer hybrid frequency synthesizer.

Referring now to FIG. 1, a generalized embodiment of the present invention is illustrated in schematical block diagram form. In FIG. 1, a direct digital synthesizer/direct analog synthesizer (DDS/DAS) hybrid frequency synthesizer is illustrated. The DDS/DAS of FIG. 1 has digital frequency synthesis means comprised of direct digital synthesizer (DDS) 10, digital-to-analog converter 12, and filter 14, typically a low pass filter. The digital frequency synthesis means is utilized for digitally generating an analog signal in a predetermined frequency range of f to $f+\Delta f$.

DDS 10 is typically comprised of a phase accumulator (not shown) and a look-up tuble (also not shown) as is known in the art. DDS 10 receives phase data and a clock signal as inputs thereto. DDS 10 operates by accumulating incremental changes in phase at a constant clock rate, which determines the frequency of the output, converting the accumulated phase to amplitude data using a device such as a ROM look-up table for conversion of the resulting amplitude data to analog form by DAC 12. Filter 14 is used to remove from the analog signal undesired frequency components and spurs produced during the signal generation process. An example of such digital generatin of an analog signal is disclosed in U.S. Pat. No. 4,905,177, assigned to the Assignee of the present invention, the disclosure of which is incorporated by reference herein.

The digitally generated signal (DDS signal) is output from filter 14 to an input stage analog frequency synthesis means 16 comprised of mixer 18 and frequency selector means or switch 20. Input stage 16 further has a filter means comprised of filter input selector means or switch 22, a bank of filters $24_1$-$24_I$, typically bandpass filters, and filter output selector means or switch 26. Switch 20, along with switches 22 and 26, may be implemented as a pin diode switching arrangement as is well known in the art or any other similar switching arrangement.

Frequency generator 28 generates a first plurality of output signals wherein the first signal is of a frequency of $f_A$ and a last is of a frequency of $f_A+(I-1)\Delta f$, where I is equal to the number of first plurality of output signals provided to switch 20. Each signal of the first plurality of signals differ in frequency from a next one by a frequency increment $\Delta f$. Of the first plurality of signals each are provided to a respective input or terminal $A_1$-$A_I$ of switch 20.

Switch 20, in response to an input switch control signal A, couples a selected one of the signals $f_A$ through $f_A+(I-1)\Delta f$ output from frequency generator 28 to one input of mixer 18. The other input of mixer 18 is coupled to the output of filter 14 for receiving the filtered digitally generated output signal. Mixer 18 mixes the two input signals so as to provides an output signal that contains frequency components that correspond to the sum and the difference of the frequencies of the input signals.

Switch 22, also responsive to switch control signal A, couples the output of mixer 18 to one output or terminal $A_1$-$A_I$ of switch 22. Each output terminal of switch 22 is coupled to an input of a respective one of bandpass filters $24_1$-$24_I$. Each of filters $24_1$-$24_I$ has a different passband so as to filter out one of the sum or difference frequency components of a different one of the DDS signal/frequency generator first plurality signal combinations.

Figure 2:
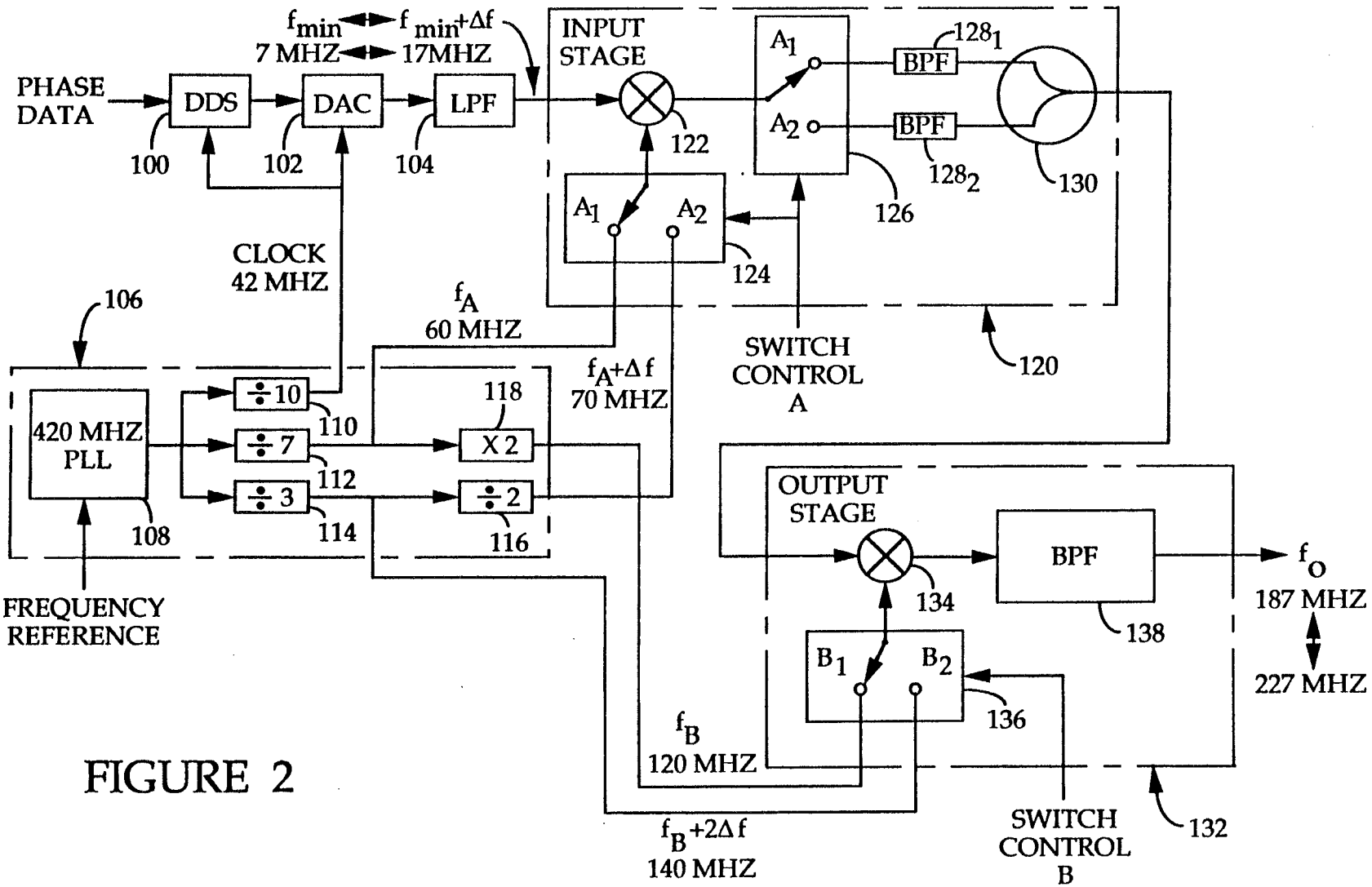
FIG. 2 is a schematical block diagram illustrating an exemplary embodiment of a direct digital synthesizer/-direct analog synthesizer hybrid frequency synthesizer having two stages of analog frequency synthesis.

The signal as filtered by one of filters $24_1$-$24_I$ is output to a respective one of inputs or terminals $A_1$-$A_I$ of switch 26. Switch 26 is also responsive to switch control signal A for coupling the filtered signal to one or more series coupled intermediate stage analog frequency synthesis means or an output stage analog frequency synthesis means. In the alternative, switch 26 may be replaced by a power combiner, such as illustrated in FIG. 2. Similarly, switch 22 may be replaced by a power splitter with switch 26 remaining a switch as illustrated in FIG. 1.

The signal output from input stage 16 provides continuous frequency coverage, at the resolution of the DDS over the frequency band $f+f_A$ to $f+f_A+I\Delta f$. Although the frequency range of the signal output from the input stage is translated in frequency to a different frequency band from that of the DDS signal, bandwidth expansion of the DDS signal is provided in the output signal while retaining the resolution of the DDS signal.

As illustrated in FIG. 1, the output of input stage 16 is coupled to the input of optional intermediate stage 30. Intermediate stage 30 is constructed in a manner similar to that of input stage 16. Intermediate stage 30 is comprised of mixer 32 and frequency selector means or switch 34. Intermediate stage 30 further has a filter means comprised of filter input selector means or switch 36, a bank of filters $38_1$-$38_J$, typically bandpass filters, and filter output selector means or switch 40. Switch 34, along with switches 36 and 40, may be again implemented as a pin diode switching arrangement as is well known in the art or any other similar switching arrangement.

Frequency generator 28 generates a second plurality of output signals wherein the first signal is of a frequency of $f_B$ and a last is of a frequency of $f_B+(J-1)I\Delta f$ where J is equal to the number of second plurality of output signals provided to switch 34. Each signal of the second plurality of signals differ in frequency from a next one by a frequency increment $I\Delta f$. Of the second plurality of signals are each provided to a respective input or terminal $B_1$-$B_J$ of switch 34.

Switch 34, in response to an input switch control signal B, couples one of the signals $f_B$ through $f_B+(J-1)I\Delta f$ output from frequency generator 28 to one input of mixer 32. The other input of mixer 32 is coupled to the output of switch 26 for receiving the input stage output signal. Mixer 32 mixers the two input signals so as to provides an output signal that contains frequency components that correspond to the sum and the difference of the frequencies of the input signals.

Switch 36, also responsive to switch control signal B, couples the output of mixer 32 to one output or terminal $B_1$-$B_J$ of switch 36. Each output terminal of switch 36 is coupled to an input of a respective one of bandpass filters $38_1$-$38_J$. Each of filters $38_1$-$38_J$ has a different passband so as to filter out one of the sum or difference frequency components of a different one of the input stage output signal/frequency generator second plurality signal combinations.

The signal as filtered by one of filters $38_1$-$38_J$ is output to a respective one of inputs or terminals $B_1$-$B_J$ of switch 40. Switch 40 is also responsive to switch control signal B for coupling the filtered signal to additional intermediate stage analog frequency synthesis means or an output stage analog frequency synthesis means. Again one of switches 36 and 40 may be replaced by a power combiner. As illustrated in FIG. 1, the output of input stage 16 is coupled to the input of output stage 30.

The signal output from intermediate stage 30 again provides continuous frequency coverage, at the resolution of the DDS over the frequency band $f+f_A+f_B$ to $f+f_A+f_B+JI\Delta f$. Although the frequency range of the signal output from the intermediate stage is translated in frequency to a different frequency band from that of the input stage output signal, bandwidth expansion of the original DDS signal is provided in the intermediate stage output signal while retaining the resolution of the DDS signal. The use of additional intermediate stages provides further frequency translation in addition to additional bandwidth expansion. Additional intermediate stages provides bandwidth expansion according to the multiple of the number of input signals to the stage, e.g. I and J.

As further illustrated in FIG. 1, the output of intermediate stage 30 is coupled to the input of output stage 42. Output stage 42 is constructed in a manner similar to that of input stage 16 and intermediate stage 30. Output stage 42 is comprised of mixer 44 and frequency selector means or switch 46. Output stage 42 further has a filter means comprised of filter input selector means or switch 48, a bank of filters $50_1$–$50_K$, typically bandpass filters, and filter output selector means or switch 52. Switch 46 along with switches 48 and 52, may be again implemented as a pin diode switching arrangement as is well known in the art or any other similar switching arrangement.

Frequency generator 28 generates a third plurality of output signals wherein the first signal is of a frequency of $f_N$ and a last is of a frequency of $f_N+(K-1)JI\Delta f$ where K is equal to the number of third plurality of output signals provided to switch 46. Each signal of the third plurality of signals differ in frequency from a next one by a frequency increment $Ji\Delta f$. The frequency increment is a multiple of the number frequency input signals of the preceding input stage and intermediate stage or stages. The third plurality of signals are provided to a respective input or terminal $N_1$–$N_K$ of switch 46.

Switch 46, in response to an input switch control signal N, couples one of the signals $f_N$ through $f_N+(K-1)JI\Delta f$ output from frequency generator 28 to one input of mixer 44. The other input of mixer 44 is coupled to the output of switch 40 for receiving the intermediate stage output signal. Mixer 44 again mixers the two input signals so as to provides an output signal that contains frequency components that correspond to the sum and the difference of the frequencies of the input signals.

Switch 48, also responsive to switch control signal N, couples the output of mixer 44 to one output or terminal $N_1$–$N_K$ of switch 48. Each output terminal of switch 48 is coupled to an input of a respective one of bandpass filters $50_1$–$50_K$. Each of filters $50_1$–$50_K$ has a different passband so as to filter out one of the sum or difference frequency components of a different one of the input stage output signal/frequency generator third plurality signal combinations.

The signal as filtered by one of filters $50_1$–$50_K$ is output to a respective one of inputs or terminals $N_1$–$N_K$ of switch 52. Switch 52 is also responsive to switch control signal N for coupling the filtered signal to additional intermediate stage analog frequency synthesis means or an output stage analog frequency synthesis means. Again switch 52 may be replaced by a power combiner. Furthermore, switches 48 and 52 may be eliminated along with the bank of filters $50_1$–$50_K$ and replaced by a single bandpass filter as is illustrated in FIG. 2. In an alternate configuration when using a single bandpass filter, one or both of switches 48 and 52 may be used and of a pin diode design.

The signal output from output stage 42 again provides continuous frequency coverage, at the resolution of the DDS, over the frequency band $f+f_A+f_B+f_N$ to $f+f_A+f_B+f_N+KJI\Delta f$. Although the frequency range of the signal output from the intermediate stage is translated in frequency to a different frequency band from that of the final intermediate stage output signal, bandwidth expansion of the original DDS signal is provided in the output stage output signal while retaining the resolution of the DDS signal. The bandwidth expansion may be defined by the equation $BW=I*J*K*\Delta f$.

In the example illustrated in FIG. 2, a DDS/DAS hybrid frequency synthesizer is disclosed which provides an an output signal in the exemplary frequency range 187–227 MHz with extremely fine frequency steps and fast switching speed. The frequency resolution is that of the DDS and the switching speed is determined by the RF switches used to select the various output frequency ranges. The frequency range switches select one of the four output ranges 187–197 MHz, 197–207 MHz, 207–217 MHz, or 217–227 MHz. Therefore, 40 MHz of output bandwidth is achieved using a 10 MHz bandwidth DDS without the use of frequency multiplication techniques.

FIG. 2 illustrates a two stage, base 2, DDS/DAS hybrid frequency synthesizer. DDS 100 receives phase data and an clock signal for converting, at the clock rate, the phase data to amplitude data. The amplitude data along with the clock signal is provided to DAC 102 where the amplitude data is converted, at the clock rate, to an analog signal in the frequency range of $f_{min}$ to $f_{min}+\Delta f$. In the example illustrated in FIG. 2, the frequency range of the converted DDS signal is 7 MHz to 17 MHz. The analog signal is provided to low pass filter 104 where undesired high frequency components are eliminated.

The clock signal is in the exemplary embodiment of FIG. 2 a 42 MHz clock signal provided by frequency source 106 to both DDS 100 and DAC 102. However, it should be understood that DDS 100 and DAC 102 may be clocked at different frequencies. Source 106 receives a reference frequency signal from a reference frequency generator (not shown) such a an oscillator. Source 106 is comprised of a phase lock loop (PLL) circuit 108 along with frequency dividers 110, 112, 114, and 116; and frequency multiplier 118, all being devices known in art.

The reference frequency signal is input to source 106 as an input to PLL circuit 108 which provides a 420 MHz output signal to each of dividers 110, 112, 114 where the frequency is respectively divided by a factor of 10, 7 and 3. The output from divider 110 is the 42 MHz clock signal that is provided to DDS 110 and DAC 102.

The output from divider 112 is a 60 MHZ signal that is provided as one reference frequency input ($f_A$) to input stage 120 and to multiplier 118. Multiplier 118 multiplies the received signal frequency by a factor of 2. The output from multiplier 118 is a 120 MHz signal that is provided as one reference frequency input ($f_B$) to output stage 132.

The output from divider 114 is a 140 MHZ signal that is provided as a second reference frequency input ($f_B+2\Delta f$) to output stage 132 and to divider 116. Divider 116 divides the received signal frequency by a factor of 2. The output from divider 116 is a 70 MHz signal that is provided as a second reference frequency input ($f_A+\Delta f$) to input stage 120.

Input stage 120 is comprised of mixer 122, switches 124 and 126, bandpass filters $128_1$ and $128_2$, and power combiner 130. Mixer 122 receives the filtered analog DDS signal along with a selected $f_A$ or $f_A+\Delta f$ signal. Switch 124 receives respectively at inputs $A_1$ and $A_2$ the signals $f_A$ and $f_A+\Delta f$ and provides an output of a selected one to mixer 122 in response to switch control signal A.

Mixer 122 mixes the two input signals and provides a mixer output signal to switch 126. Switch 126 in response to the switch control signal A provides an output of the mixer output signal to a selected one of bandpass filters $128_1$ and $128_2$. Bandpass filters $128_1$ and $128_2$ in the exemplary embodiment of FIG. 2 have respective passbands of 67–77 MHz and 77–87 MHz.

When switch control signal A controls selection of the frequency input of $f_A$ in switch 124 for mixing with the filtered analog DDS signal, it also controls switch 126 for selection of bandpass filter 128$_1$. Similarly, when switch control signal A controls selection of the frequency input of $f_A+\Delta f$ in switch 124 for mixing with the filtered analog DDS signal, it also controls switch 126 for selection of bandpass filter 128$_2$.

The output of the filtered signal from the selected one of bandpass filters 128$_1$ and 128$_2$ is provided as a respective input to power combiner 130. Although a power combiner is used in this exemplary embodiment, it is further understood that a switching arrangement as discussed with FIG. 1 may be implemented. Power combiner 130 couples the respective bandpass filter output as an input to output stage 132.

Output stage 132 is comprised of mixer 134, switch 136 and bandpass filter 138. Mixer 134 receives the signal output from input stage 120 along with a selected $f_B$ or $f_B+\Delta f$ signal. Switch 136 receives respectively at inputs $B_1$ and $B_2$ the signals $f_B$ and $f_B+\Delta f$ and provides an output of a selected one to mixer 134 in response to switch control signal B.

Mixer 134 mixes the two input signals and provides a mixer output signal to bandpass filter 138. Bandpass filter 138 in the exemplary embodiment of FIG. 2 has a passband of 187–227 MHz. Although only a bandpass filter is used at the output of mixer 134, it is envisioned that combinations of switches, filters and power combiner may be used.

At described above, DDS 100 via DAC 102 provides an analog output signal in the frequency range of $f_{min}$ to $f_{min}+\Delta f$, where $f_{min}=7$ MHz and $\Delta f=10$ MHZ. Therefore, the analog output signal is in the frequency range of 7 MHz to 17 MHz with the exact frequency being in steps determined by the resolution of the DDS. The resolution of a DDS is known to be greater than that of conventional analog frequency synthesizers for certain bandwidths. The frequencies provided by the various switch settings are indicated in Table I where $f_A=60$ MHz; $f_B=120$ MHz and again $\Delta f=10$ MHz. Table I further illustrates the range of possible synthesizer output frequencies for the various switch settings for the synthesizer of FIG. 2.

TABLE I

| RANGE NO. | SWITCH SETTING $A_1/A_2$ | SWITCH SETTING $B_1/B_2$ | FREQUENCY RANGE ($f_O$) LOW | FREQUENCY RANGE ($f_O$) HIGH |
|---|---|---|---|---|
| 1 | $A_1$ (60 MHz) | $B_1$ (120 MHz) | $f_A + f_B + f_{min}$ (187 MHz) | $f_A + f_B + f_{min} + \Delta f$ (197 MHz) |
| 2 | $A_2$ (70 MHz) | $B_1$ (120 MHz) | $f_A + f_B + f_{min} + \Delta f$ (197 MHz) | $f_A + f_B + f_{min} + 2\Delta f$ (207 MHz) |
| 3 | $A_1$ (60 MHz) | $B_2$ (140 MHz) | $f_A + f_B + f_{min} + 2\Delta f$ (207 MHz) | $f_A + f_B + f_{min} + 3\Delta f$ (217 MHz) |
| 4 | $A_2$ (70 MHz) | $B_2$ (140 MHz) | $f_A + f_B + f_{min} + 3\Delta f$ (217 MHz) | $f_A + f_B + f_{min} + 4\Delta f$ (227 MHz) |

Figure 3:
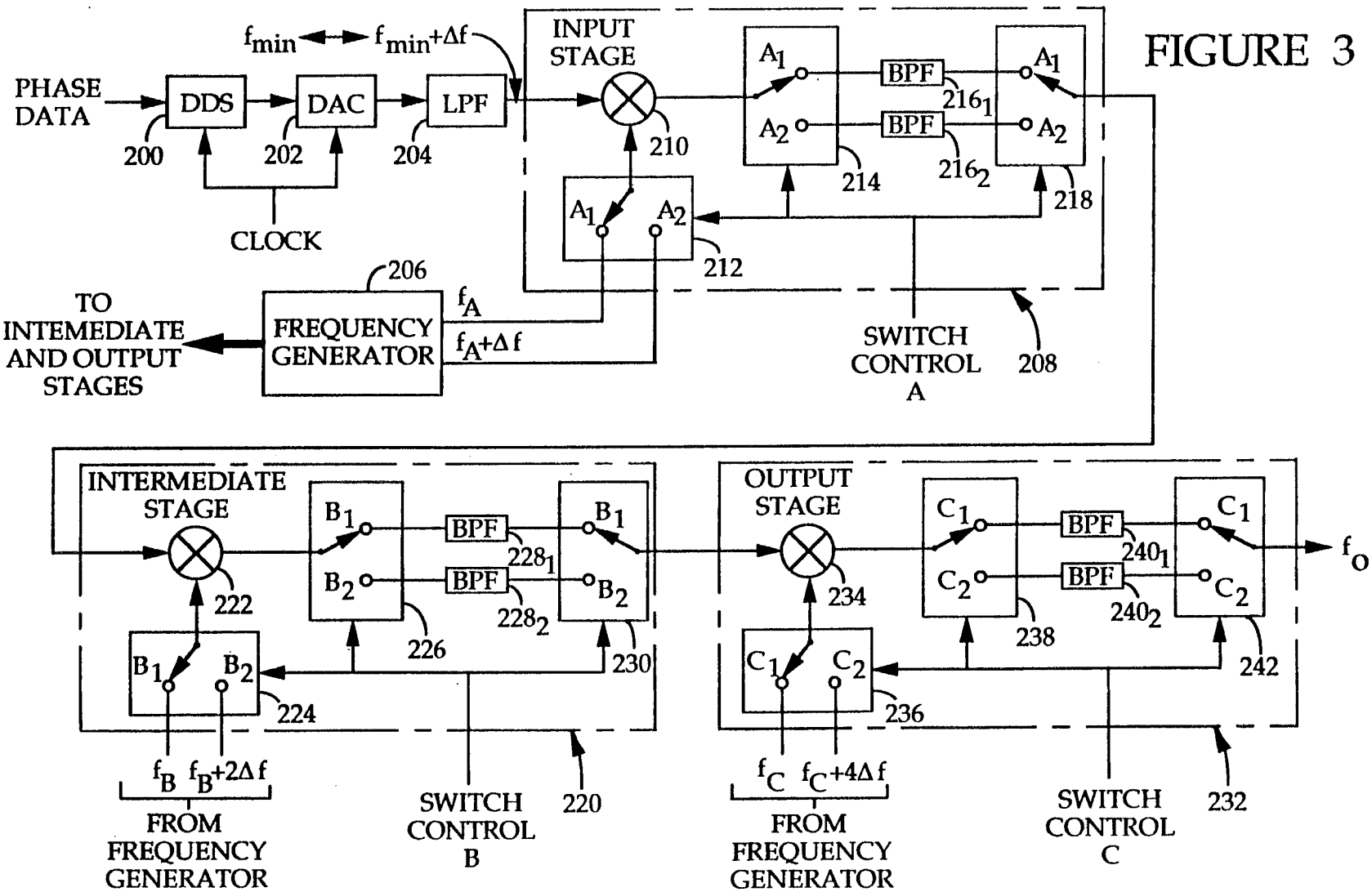
FIG. 3 is a schematical block diagram illustrating an exemplary embodiment of a direct digital synthesizer/-direct analog synthesizer hybrid frequency synthesizer having three stages of analog frequency synthesis.

Referring to FIG. 3, there is shown yet another exemplary embodiment of the present invention. In FIG. 3, a three stage, base 2, DDS/DAS hybrid frequency synthesizer is disclosed. As in FIGS. 1 and 2, DDS 200 receives phase data and an clock signal for converting, at the clock rate, the phase data to amplitude data. The amplitude data along with the clock signal is provided to DAC 202 where the amplitude data is converted, at the clock rate, to an analog signal in the frequency range of $f_{min}$ to $f_{min}+\Delta f$. The analog signal is provided to low pass filter 204 where undesired high frequency components are eliminated. Frequency generator 206 is illustrated in FIG. 3 for providing of input frequency signals to the various stages.

Input stage 208 is comprised of mixer 210; switches 212, 214 and 218; and bandpass filters 216$_1$ and 216$_2$. Mixer 210 receives the filtered analog DDS signal along with a selected $f_A$ or $f_A+\Delta f$ signal. Switch 212 receives respectively at inputs $A_1$ and $A_2$ the signals $f_A$ and $f_A+\Delta f$ from frequency generator 206 and provides an output of a selected one to mixer 210 in response to switch control signal A.

Mixer 210 mixes the two input signals and provides a mixer output signal to switch 214. Switch 214 in response to the switch control signal A provides an output of the mixer output signal to a selected one of bandpass filters 216$_1$ and 216$_2$.

The output of the filtered signal from the selected one of bandpass filters 216$_1$ and 216$_2$ is provided as a respective input switch 218. Switch 218 in response to the switch control signal A couples the output of the selected bandpass filter as an input to intermediate stage 220. Although a switch 218 is used in this exemplary embodiment, it is further understood that a power combiner as discussed with FIG. 2 may be implemented. Furthermore, switch 218 may be of a pin diode design with the outputs of filters 216$_1$ and 216$_2$ sharing a common input to switch 218.

When switch control signal A controls selection of the frequency input of $f_A$ in switch 212 for mixing with the filtered analog DDS signal, it also controls switches 214 and 218 for selection of bandpass filters 216$_1$. Similarly, when switch control signal A controls selection of the frequency input of $f_A+\Delta f$ in switch 212 for mixing with the filtered analog DDS signal, it also controls switches 214 and 218 for selection of bandpass filter 216$_2$.

Intermediate stage 220 is comprised of mixer 222; switches 222, 226 and 230; and bandpass filters 228$_1$ and 228$_2$. Mixer 222 receives the signal output from input stage 208 along with a selected $f_B$ or $f_B+2\Delta f$ signal. Switch 224 receives respectively at inputs $B_1$ and $B_2$ the signals $f_B$ and $f_B+2\Delta f$ from frequency generator 206 and provides an output of a selected one to mixer 222 in response to switch control signal B.

Mixer 222 mixes the two input signals and provides a mixer output signal to switch 226. Switch 226 in response to the switch control signal B provides an output of the mixer output signal to a selected one of bandpass filters 228$_1$ and 228$_2$.

The output of the filtered signal from the selected one of bandpass filters 228$_1$ and 228$_2$ is provided as a respective input to switch 230. Switch 230 in response to the switch control signal B couples the output of the selected bandpass filter as an input to output stage 232. Although a switch 218 is used in this exemplary embodiment, it is further understood that a power combiner as discussed with FIG. 2 may be implemented.

When switch control signal B controls selection of the frequency input of $f_B$ in switch 224 for mixing with the input stage output signal, it also controls switches 226 and 230 for selection of bandpass filter $228_1$. Similarly, when switch control signal B controls selection of the frequency input of $f_B+2\Delta f$ in switch 224 for mixing with the input stage output signal, it also controls switches 226 and 230 for selection of bandpass filter $228_2$.

Output stage 232 is comprised of mixer 234; switches 236, 238 and 242; and bandpass filters $240_1$ and $240_2$. Mixer 234 receives the signal output from intermediate stage 220 along with a selected $f_C$ or $f_C+4\Delta f$ signal. Switch 236 receives respectively at inputs $C_1$ and $C_2$ the signals $f_C$ and $f_C+4\Delta f$ from frequency generator 206 and provides an output of a selected one to mixer 234 in response to switch control signal C.

Mixer 234 mixes the two input signal and provides a mixer output signal to switch 238. Switch 238 in response to the switch control signal C provides an output of the mixer output signal to a selected one of bandpass filters $240_1$ and $240_2$.

The output of the filtered signal from the selected one of bandpass filters $240_1$ and $240_2$ is provided as a respective input to switch 242. Switch 242 in response to the switch control signal C couples the output of the selected bandpass filter to an output of output stage 232. Although in output stage 232, switches 238 and 240 along with multiple bandpass filters are used, it is further understood that a single wider passband filter and/or a power combiner as discussed with FIG. 2 may be implemented.

As discussed with respect to input and intermediate stages 208 and 220, in output stage 232 when switch control signal C controls selection of the frequency input of $f_C$ in switch 236 for mixing with the intermediate stage output signal, it also controls switches 238 and 242 for selection of bandpass filter $240_1$. Similarly, when switch control signal C controls selection of the frequency input of $f_C+4\Delta f$ in switch 236 for mixing with the intermediate stage output signal, it also controls switches 238 and 242 for selection of bandpass filter $240_2$.

Table II illustrates the range of possible synthesizer output frequencies for the various switch settings for the synthesizer of FIG. 3.

TABLE II

| RANGE NO. | SWITCH SETTING $A_1/A_2$ | $B_1/B_2$ | $C_1/C_2$ | FREQUENCY RANGE LOW | HIGH |
|---|---|---|---|---|---|
| 1 | $A_1$ | $B_1$ | $C_1$ | $f_A + f_B + f_C + f_{min}$ | $f_A + f_B + f_C + f_{min} + \Delta f$ |
| 2 | $A_2$ | $B_1$ | $C_1$ | $f_A + f_B + f_C + f_{min} + \Delta f$ | $f_A + f_B + f_C + f_{min} + 2\Delta f$ |
| 3 | $A_1$ | $B_2$ | $C_1$ | $f_A + f_B + f_C + f_{min} + 2\Delta f$ | $f_A + f_B + f_C + f_{min} + 3\Delta f$ |
| 4 | $A_2$ | $B_2$ | $C_1$ | $f_A + f_B + f_C + f_{min} + 3\Delta f$ | $f_A + f_B + f_C + f_{min} + 4\Delta f$ |
| 5 | $A_1$ | $B_1$ | $C_2$ | $f_A + f_B + f_C + f_{min} + 4\Delta f$ | $f_A + f_B + f_C + f_{min} + 5\Delta f$ |
| 6 | $A_2$ | $B_1$ | $C_2$ | $f_A + f_B + f_C + f_{min} + 5\Delta f$ | $f_A + f_B + f_C + f_{min} + 6\Delta f$ |
| 7 | $A_1$ | $B_2$ | $C_2$ | $f_A + f_B + f_C + f_{min} + 6\Delta f$ | $f_A + f_B + f_C + f_{min} + 7\Delta f$ |
| 8 | $A_2$ | $B_2$ | $C_2$ | $f_A + f_B + f_C + f_{min} + 7\Delta f$ | $f_A + f_B + f_C + f_{min} + 8\Delta f$ |

Figure 4:
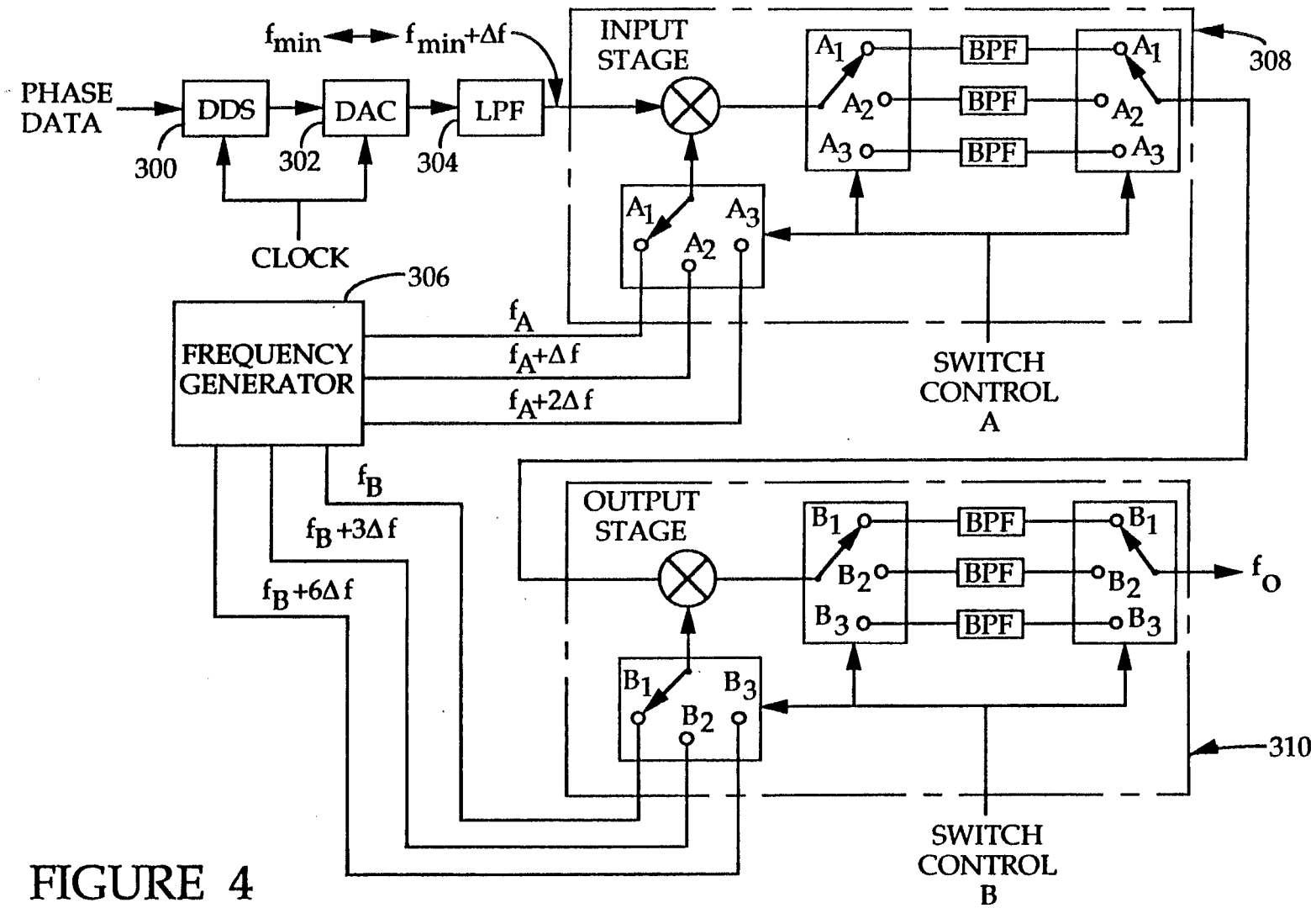
FIG. 4 is a is a schematical block diagram illustrating an alternate exemplary embodiment of a direct digital synthesizer/direct analog synthesizer hybrid frequency synthesizer having stages of analog frequency synthesis.

Referring to FIG. 4, there is shown still yet another exemplary embodiment of the present invention. In FIG. 4, a two stage, base 3, DDS/DAS hybrid frequency synthesizer is disclosed. As in FIGS. 1, 2 and 3, DDS 300 receives phase data and an clock signal for converting, at the clock rate, the phase data to amplitude data. The amplitude data along with the clock signal is provided to DAC 302 where the amplitude data is converted, at the clock rate, to an analog signal in the frequency range of $f_{min}$ to $f_{min}+\Delta f$. The analog signal is provided to low pass filter 304 where undesired high frequency components are eliminated. Frequency generator 306 is illustrated in FIG. 4 for providing of input frequency signals to the various stages.

Frequency generator 206 provides the frequency input signals $f_A$, $f_A+\Delta f$, and $f_A+2\Delta f$ to input stage 308 and the frequency input signals $f_B$, $f_B+3\Delta f$, and $f_B+6\Delta f$ to output stage 310. Input and output stages 308 and 310 may be constructed in a manner similar to that described with reference to FIGS. 1, 2 and 3.

The frequency synthesizer of FIG. 4 provides frequency coverage for the input stage in three ranges: $f_A+f_{min}$ to $f_A+f_{min}+\Delta f$; $f_A+f_{min}+\Delta f$ to $f_A+f_{min}+2\Delta f$; and $f_A+f_{min}+2\Delta f$ to $f_A+f_{min}+3\Delta f$ at the resolution of the DDS. The frequency synthesizer on the whole provides complete frequency coverage in nine ranges from $f_A+f_B+f_{min}$ to $f_A+f_B+f_{min}+9\Delta f$ at the resolution of the DDS.

In general, the number of ranges is is equal to the multiplication of the number of input frequencies (or ranges) of each stage and the number of stages. Bandwidth expansion is thus equal to the number of ranges times the frequency increment $\Delta f$. Bandwidth expansion may be defined by the equation $BW=I*J*K* \ldots *\Delta f$. As disclosed herein additional stages, each multiplying with a selection of two or more local oscillator signals, can be used to provide increased bandwidth expansion and higher output frequencies.

The performance analysis of the DDS/DAS hybrid frequency synthesizer of the present invention is relatively straightforward. A conventional intermodulation product analysis must be performed to determine the spurious content of the output signal, and the frequency plan selected accordingly. Phase noise performance is excellent due to the inherently high performance of the DDS. Should a phase lock loop as implemented in FIG. 2 be used to provide the analog frequency synthesizer signals, optimization of its noise performance is a relatively easy task since it is not required to switch between output frequencies.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. A frequency synthesizer comprising:

digital frequency synthesis means for generating a digital frequency signal, converting said digital frequency signal to analog form, and providing an output of said converted digital frequency signal as a digital frequency synthesis means output signal wherein said digital frequency synthesis means output signal is of a predetermined frequency within a frequency range of f to $f+\Delta f$;

input stage analog frequency synthesis means for, receiving said digital frequency synthesis means output signal, receiving an input of a plurality of I input stage input signals wherein each input stage input signal of said plurality of I input stage input signals is in analog form and separated in frequency from a next one by a maximum frequency increment of $\Delta f$ with a first one and a last one of said plurality of I input stage input signals are respectively of a frequency of $f_A$ and $f_A+(I-1)\Delta f$, mixing a selected one of said plurality of I input stage input signals with said digital frequency synthesis means output signal and providing a resultant input stage output signal of a frequency within a frequency range of a minimum of $f_A+f$ to a maximum of $f_A+f+I\Delta f$; and output stage analog frequency synthesis means for, receiving said input stage output signal, receiving an input of a plurality of K output stage input signals wherein each output stage input signal of said plurality of K output stage input signals is in analog form and separated in frequency from a next one by a maximum frequency increment of $I\Delta f$ with a first one and a last one of said plurality of K output stage input signals are respectively of a minimum and a maximum frequency of $f_N$ and $f_N+(K-1)I\Delta f$, mixing a selected one of said plurality of K output stage input signals with said input stage output signal and providing a resultant output stage output signal of a frequency within a frequency range of a minimum of $f_N+f_A+f$ to a maximum of $f_N+f_A+f+KI\Delta f$.

2. The frequency synthesizer of claim 1 further comprising intermediate stage analog frequency synthesis means disposed between said input stage analog frequency synthesis means and said output stage analog frequency synthesis means, said intermediate stage analog frequency synthesis means for, receiving an input of a plurality of J intermediate stage input signals each in analog form and separated in frequency from a next one by a maximum frequency increment of $I\Delta f$ wherein a first one and a last one of said output stage input signals are respectively of a minimum and a maximum frequency of $f_B$ and $f_B+(J-1)I\Delta f$, mixing a selected one of said plurality of said J intermediate stage input signals with said input stage analog frequency synthesis means output signal and providing a resultant intermediate stage output signal of a frequency within a frequency range of a minimum of $f_B+f_A+f$ to a maximum of $f_B+f_A+f+JI\Delta f$ as an input to said output stage analog frequency synthesis means, wherein each one of said plurality of K output stage input signals is separated in frequency from a next one by a maximum frequency increment of $JI\Delta f$ and wherein a first one and a last one of said plurality of K output stage input signals are respectively of a frequency of $f_N$ and $f_N+(K-1)JI\Delta f$, and wherein said output stage output signal is of a frequency within a frequency range of a minimum of $f_N+f_B+f_A+f$ to a maximum of $f_N+f_B+f_A+f+KJI\Delta f$.

3. The frequency synthesizer of claim 1 further comprising frequency generator means for generating said input stage input signals and said output stage input signals.

4. The frequency synthesizer of claim 2 further comprising frequency generator means for generating said input stage input signals, said intermediate stage input signals, and said output stage input signals.

5. The frequency synthesizer of claim 1 further comprising at least one intermediate stage analog frequency synthesis means disposed in series between said input stage analog frequency synthesis means and said output stage analog frequency synthesis means, each intermediate stage frequency synthesis means for, receiving a different plurality of analog intermediate stage input signals wherein each plurality of intermediate stage input signals are of a different frequency range with each intermediate stage input signals in each different plurality of intermediate stage input signals are different in frequency from one another by at least one predetermined multiple of said frequency increment $\Delta f$, mixing in each intermediate stage frequency synthesis means a selected intermediate stage input signal with a preceding stage output signal and providing a corresponding intermediate stage output signal.

6. The frequency synthesizer of claim 1 wherein said digital frequency synthesis means comprises:

direct digital synthesizer means for receiving digital phase data and a clock signal and for converting said phase data into digital amplitude data;

converter means for, receiving said amplitude data and said clock signal, converting said amplitude data to analog form, and providing a corresponding converter output signal; and filter means for receiving and filtering undesirable spectral components from said converter output signal, and providing a corresponding filtered converter output signal as said digital frequency synthesis means output signal.

7. The frequency synthesizer of claim 1 wherein said input stage analog frequency synthesis means comprises:

frequency selector means for receiving said input stage input signals and an input stage frequency selection signal, said frequency selector means responsive to said input stage frequency selection signal for providing an output of said selected input stage input signal;

mixer means for receiving said digital frequency synthesis means output signal and said selected input stage input signal, generating a mixer output signal with frequency components corresponding to a sum and a difference in frequency of said digital frequency synthesis means output signal and said selected input stage input signal; and filter means for receiving said mixer output signal and filtering a predetermined one of said sum and difference frequency components from said mixer output signal so as to provide said filtered mixer output signal as said input stage output signal.

8. The frequency synthesizer of claim 1 wherein said output stage analog frequency synthesis means comprises:

frequency selector means for receiving said output stage input signals and an output stage frequency selection signal, said frequency selector means responsive to said output stage frequency selection signal for providing an output of said selected output stage input signal;

mixer means for receiving said input stage output signal and said selected output stage input signal, generating a mixer output signal with frequency components corresponding to a sum and a difference in frequency of said input stage output signal and said selected output stage input signal; and filter means for receiving said mixer output signal and filtering a predetermined one of said sum and difference frequency components from said mixer output signal so as to provide said filtered mixer output signal as said output stage output signal.

9. The frequency synthesizer of claim 2 wherein said input stage analog frequency synthesis means comprises:

first frequency selector means for receiving said input stage input signals and an input stage frequency selection signal, said first frequency selector means responsive to said input stage frequency selection signal for providing an output of said selected input stage input signal;

first mixer means for receiving said digital frequency synthesis means output signal and said selected input stage input signal, generating a first mixer output signal with frequency components corresponding to a sum and a difference in frequency of said digital frequency synthesis means output signal and said selected input stage input signal; and first filter means for receiving said first mixer output signal and filtering a predetermined one of said sum and difference frequency components from said first mixer output signal so as to provide said filtered first mixer output signal as said input stage output signal.

10. The frequency synthesizer of claim 9 wherein said output stage analog frequency synthesis means comprises:

second frequency selector means for receiving said output stage input signals and an output stage frequency selection signal, said second frequency selector means responsive to said input stage frequency selection signal for providing an output of said selected output stage input signal;

second mixer means for receiving said input stage analog frequency synthesis means output signal and said selected output stage input signal, generating a second mixer output signal with frequency components corresponding to a sum and a difference in frequency of said input stage analog frequency synthesis means output signal and said selected output stage input signal; and second filter means for receiving said second mixer output signal and filtering a predetermined one of said sum and difference frequency components from said second mixer output signal so as to provide said filtered second mixer output signal as said output stage output signal.

11. The frequency synthesizer of claim 9 wherein said intermediate stage analog frequency synthesis means comprises:

third frequency selector means for receiving said intermediate stage input signals and an intermediate stage frequency selection signal, said third frequency selector means responsive to said intermediate stage frequency selection signal for providing an output of said selected intermediate stage input signal;

third mixer means for receiving said input stage analog frequency synthesis means output signal and said selected input stage input signal, generating a third mixer output signal with frequency components corresponding to a sum and a difference in frequency of said input stage output signal and said selected intermediate stage input signal; and third filter means for receiving said third mixer output signal and filtering a predetermined one of said sum and difference frequency components from said third mixer output signal so as to provide said filtered third mixer output signal as an input to said output stage first mixer means.

12. The frequency synthesizer of claim 7 wherein said filter means comprises:

filter input selector means, having an input terminal and a plurality of output terminals, for, receiving said mixer output signal at said filter input means input terminal, said filter input selection means further for receiving said input stage frequency selection signal and responsive thereto for coupling said mixer output signal to a selected one of said plurality of filter input selector means output terminals; and a plurality of bandpass filters each having an input and an output, each bandpass filter coupled at its input to a respective one of said filter input selector means output terminals.

13. The frequency synthesizer of claim 12 wherein said filter means further comprises filter output selector means, having a plurality of input terminals and an output terminal, each filter output selector means input terminal coupled to a respective one of said bandpass filter outputs, said filter output selection means for receiving said input stage frequency selection signal and responsive thereto for coupling a selected one of said plurality of filter output selector means input terminals to said filter output selector means output terminal.

14. The frequency synthesizer of claim 8 wherein said filter means comprises:

filter input selector means, having an input terminal and a plurality of output terminals, for, receiving said mixer output signal at said filter input means input terminal, said filter input selection means further for receiving said output stage frequency selection signal and responsive thereto for coupling said mixer output signal to a selected one of said plurality of filter input selector means output terminals; and a plurality of bandpass filters each having an input and an output, each bandpass filter coupled at its input to a respective one of said filter input selector means output terminals.

15. The frequency synthesizer of claim 14 wherein said filter means further comprises filter output selector means, having a plurality of input terminals and an output terminal, each filter output selector means input terminal coupled to a respective one of said bandpass filter outputs, said filter output selection means for receiving said output stage frequency selection signal and responsive thereto for coupling a selected one of said plurality of filter output selector means input terminals to said filter output selector means output terminal.

16. A high resolution, expanded bandwidth frequency synthesizer comprising:

a digital frequency synthesizer capable of digitally generating an analog output signal in a frequency range of $f_{min}$ to $f_{min}+\Delta f$ comprising:

a direct digital synthesizer (DDS) having a phase data input, a DDS clock input, and a DDS output;

a digital to analog converter (DAC) having a data input coupled to said DDS output, a clock input and an output;

a filter having an input coupled to said DAC output and an output;

an analog input frequency synthesizer capable of converting said digital frequency output signal to an input frequency synthesizer signal in a frequency range of $(f_A+f_{min})$ to $(f_A+f_{min}+I\Delta f)$ comprising:

a first mixer having a pair of inputs and an output, one of said first mixer inputs coupled to said digital frequency synthesizer filter output and another one of said first mixer inputs for receiving a selected input signal of a first plurality of I input signals each different from one another by a frequency increment $\Delta f$, a first input signal of said first plurality of input signals at a frequency of $f_A$ and a last input signal of said first plurality of input signals at a frequency of $f_A+(I-1)\Delta f$;

a plurality of bandpass filters each having an input and an output, said bandpass filter outputs electrically coupled together; and filter selector means, coupled to said first mixer output, for receiving a first selector signal and responsive thereto for coupling said first mixer output to an input of a selected one of said bandpass filters; and an analog output frequency synthesizer capable of converting said input frequency synthesizer signal to an output frequency synthesizer signal in a frequency range of $(f_A+f_B+f_{min})$ to $(f_A+f_B+f_{min}+KI\Delta f)$ comprising:

a second mixer having a pair of inputs and an output, one of said second mixer inputs electrically coupled to said bandpass filter outputs and another one of said second mixer inputs for receiving a selected input signal of a a second plurality of K input signals each different from one another by a frequency increment $I\Delta f$, a first input signal of said second plurality of input signals at a frequency of $f_N$ and a last input signal of said second plurality of input signals at a frequency of $f_N+(K-1)I\Delta f$; and an output bandpass filter having an input and an output, said output bandpass filter input coupled to said second mixer output.

17. The frequency synthesizer of claim 16 wherein said analog input frequency synthesizer further comprises first switch means for receiving said first plurality of input signals and said first selector signal, said first switch means responsive to said first selector signal for providing an output of said selected one of said first plurality of input signals to said another one of said first mixer inputs.

18. The frequency synthesizer of claim 16 wherein said analog output frequency synthesizer further comprises first switch means for receiving said second plurality of input signals and a first switch signal, said first switch means responsive to said first switch signal for providing an output of a selected one of said second plurality of input signals to said another one of said first mixer inputs.

19. The frequency synthesizer of claim 17 wherein said analog output frequency synthesizer further comprises second switch means for receiving said second plurality of input signals and a first switch signal, said second switch means responsive to said first switch signal for providing an output of a selected one of said second plurality of input signals to said another one of said first mixer inputs.

20. The frequency synthesizer of claim 16 further comprising a power combiner disposed between said plurality of bandpass filters and said second mixer, said power combiner having a plurality of inputs each coupled to a respective output of each bandpass filter of said plurality of bandpass filters and an output coupled to said second mixer input.

21. The frequency synthesizer of claim 16 further comprising additional filter selector means, disposed between said plurality of bandpass filters outputs and said second mixer, for receiving said first selector signal and responsive thereto for coupling an output of said selected one of said bandpass filters to said second mixer input.

22. A method for frequency synthesis comprising the steps of:

generating through direct digital synthesis and digital to analog signal conversion a first output signal of a predetermined frequency within a frequency range of f to $f+\Delta f$;

mixing a first input signal of a first plurality of I input signals with said first output signal and providing a resultant second output signal, each input signal of said first plurality of input signals separated in frequency from a next one by a frequency increment of $\Delta f$ and wherein first and last input signals of said first plurality of input signals are respectively of a frequency of $f_A$ and $f_A+(I-1)\Delta f$; and mixing a second input signal of a second plurality of K input signals with said second output signal and providing a resultant third output signal, each input signal of said second plurality of input signals separated in frequency from a next one by a frequency increment of $I\Delta f$ wherein first and last input signals of said second plurality of input signals are respectively of a frequency of $f_N$ and $f_N+(K-1)I\Delta f$, and wherein said third output signal is of a frequency in the frequency range of $f_N+f_A+f$ to $f_N+f_A+f+KI\Delta f$.

23. The method of claim 22 further comprising the steps of:

generating said first and second pluralities of input signals;

selecting said first input signal from said first plurality of input signals;

providing said first input signal for mixing with said first output signal;

selecting said second input signal from said second plurality of input signals; and providing said second input signal for mixing with said second output signal.

24. The method of claim 22 further comprising the steps of:

filtering undesired frequency components from said second output signal; and filtering undesired frequency components from said third output signal.

25. An apparatus for providing expanded bandwidth, high resolution frequency synthesis, comprising:

first frequency synthesis means for generating a digital frequency signal representative of an analog frequency signal of a predetermined frequency within a frequency range of f to $f+\Delta f$, converting said digital signal to analog form, and providing said converted digital frequency signal as a first output signal; and second frequency synthesis means for, combining said first output signal with a selected one of a first plurality of I analog input signals each separated in frequency from a next one another by a maximum frequency increment of $\Delta f$ with a first and last one respectively of a minimum and maximum frequency of $f_A$ and $f_A+(I-1)\Delta f$, and providing a resultant analog second output signal in the frequency range of $f_A+f$ to $f_A+f+I\Delta f$.

26. The apparatus of claim 25 further comprising a third frequency synthesis means for, combining said second output signal with a selected one of a second plurality of K analog input signals each separated in frequency from a next one another by a maximum frequency increment of $I\Delta f$ with a first and last one respectively of a minimum and maximum frequency of $f_N$ and $f_N+(K-1)I\Delta f$, and providing a resultant analog third output signal in the frequency range of $f_N+f_A+f$ to $f_N+f_A+f+KI\Delta f$.

27. The apparatus of claim 25 wherein said first frequency synthesis means comprises:

a direct digital synthesizer (DDS) having a phase data and clock inputs and an output; and a digital to analog converter (DAC) having an input coupled to said DDS output, and an output.

28. The apparatus of claim 25 wherein said second frequency synthesis means comprises:

a switch having a plurality of reference frequency signal inputs, a control signal input and and output; and a first mixer having a pair of inputs and an output, one of said first mixer inputs coupled to said first frequency synthesis means for receiving said first output signal and another of said first mixer inputs coupled to said switch output.

29. The apparatus of claim 27 wherein said second frequency synthesis means comprises:

a switch having a plurality of reference frequency signal inputs, a control signal input and and output; and a mixer having a pair of inputs and an output, one of said mixer inputs coupled to said first frequency synthesis means for receiving said first output signal and another of said mixer inputs coupled to said switch output.

30. The apparatus of claim 26 wherein said first frequency synthesis means comprises:

a direct digital synthesizer (DDS) having a phase data and clock inputs and an output; and a digital to analog converter (DAC) having an input coupled to said DDS output, and an output.

31. The apparatus of claim 30 wherein said second frequency synthesis means comprises:

a first switch having a plurality of reference frequency signal inputs, a control signal input and and output; and a first mixer having a pair of inputs and an output, one of said first mixer inputs coupled to said first frequency synthesis means for receiving said first output signal and another of said first mixer inputs coupled to said switch output.

32. The apparatus of claim 31 wherein said third frequency synthesis means comprises:

a second switch having a plurality of reference frequency signal inputs, a control signal input and and output; and a second mixer having a pair of inputs and an output, one of said second mixer inputs coupled to said first mixer output and another of said second mixer inputs coupled to said second switch output.

* * * * *